US006861595B2

(12) United States Patent
Passow

(10) Patent No.: US 6,861,595 B2
(45) Date of Patent: Mar. 1, 2005

(54) CONTACT BLOCK ASSEMBLY AND A METHOD FOR ASSEMBLING THE SAME

(75) Inventor: Christian H. Passow, Ann Arbor, MI (US)

(73) Assignee: Siemens Energy & Automation Inc., Alpharetta, GA (US)

( * ) Notice: Subject to any disclaimer, the term of this patent is extended or adjusted under 35 U.S.C. 154(b) by 0 days.

(21) Appl. No.: 10/661,247

(22) Filed: Sep. 12, 2003

(65) Prior Publication Data

US 2004/0050676 A1 Mar. 18, 2004

Related U.S. Application Data

(62) Division of application No. 09/961,158, filed on Sep. 21, 2001, now Pat. No. 6,642,823.

(51) Int. Cl.[7] ..... H01H 1/00
(52) U.S. Cl. ..... 200/16 R; 200/16 A; 200/16 C
(58) Field of Search ..... 200/16 R–16 C, 200/520, 530, 532, 534, 535, 303, 307, 243, 246, 247, 250, 280, 281, 447, 443, 293, 295

(56) References Cited

U.S. PATENT DOCUMENTS 4,276,458 A * 6/1981 Alter ..... 200/245
4,306,123 A * 12/1981 Taylor ..... 200/16 A
4,401,867 A * 8/1983 Grunst ..... 200/443
6,198,058 B1 * 3/2001 Graninger et al. ..... 200/50.02
6,642,823 B2 * 11/2003 Passow ..... 335/132
6,667,448 B2 * 12/2003 Schaefer ..... 200/16 A
6,720,510 B2 * 4/2004 Passow ..... 200/243

* cited by examiner

*Primary Examiner*—Michael A. Friedhofer

(57) ABSTRACT

A contact block assembly comprising a pusher having a body portion; a window formed in the body portion; a movable contact positioned within the window; a recess formed in the body portion; a first spring positioned within the recess and abutting the movable contact; and second spring positioned outside the pusher and abutting the movable contact is disclosed. A method of assembling a contact block assembly, the method comprising the steps of inserting a first spring into a recess in a pusher; inserting a movable contact within a window of the pusher and in contact with the first spring; and positioning a second spring outside the pusher and in contact with the movable contact.

14 Claims, 5 Drawing Sheets

CONTACT BLOCK ASSEMBLY AND A METHOD FOR ASSEMBLING THE SAME

This is a divisional of application Ser. No. 09/961,158 filed Sep. 21, 2001 now U.S. Pat. No. 6,642,823.

CROSS-REFERENCE TO RELATED PATENT APPLICATIONS

The present U.S. patent application having at least one common inventor as:

U.S. patent application Ser. No. 09/961,155 entitled "System and Method for Auxiliary Contact Assembly" (2001P17284 US), and U.S. patent application Ser. No. 09/961,159 entitled "System and Method for Auxiliary Contact Assembly and Snap Mounting" (2001P17283 US), and U.S. patent application Ser. No. 09/961,162 entitled "System and Method for Mounting a Pusher and Moveable Contact in a Contact Block" (2001P17288US), and U.S. patent application Ser. No. 09/961,156 entitled "System and Method for Mounting a Moveable Contact in a Contact Block" (2001P17289 US), and U.S. patent application Ser. No. 09/961,161 entitled "Pusher Assembly and Method 3 for Assembling a Pusher Assembly" (2001P17280US), and U.S. patent application Ser. No. 09/961,160 entitled "Movable Contact and a Method of Assembling a Pusher Assembly having a Movable Contact" (2001P17281US), which are filed with the U.S. Patent and Trademark Office concurrently on Sep. 21, 2001, the entirety of each being incorporated herein by reference.

FIELD OF THE INVENTION

The present invention relates to a contact block assembly, and more particularly to a contact block assembly having a return spring positioned outside a pusher.

BACKGROUND OF THE INVENTION

In designing a contact block, it is important to keep the "pusher return force" in these contact blocks as low as possible, so that momentary selector switches can operate as many contact blocks as possible. To operate properly, a compression spring must rotate a cam that in turn forces the pusher into the contact block by overcoming the pusher return force. While most pushbuttons and selector switches can operate eight contact blocks simultaneously (two stacks of four deep), the present Siemens class 52 momentary selector switches are limited to operating four contact blocks.

Achieving a lower spring rate allows a lower compressed pusher return force because (i) the force applied by the return spring when the pusher has been forced into the contact block is the force applied by the return spring when the pusher is extended plus the pusher travel multiplied by the spring rate and (ii) the force applied by the return spring when the pusher is extended and the pusher travel are essentially fixed.

While a lower spring rate can be achieved by adding extra turns to a spring, the extra turns, however, increase the solid height of the spring. Consequently, when starting with a spring whose rate is already minimized, a lower spring rate can be further achieved by increasing the maximum allowable solid height of the spring. The top of the return spring of conventional contact blocks (which is mounted inside the pusher) requires clearance for the end of an extended pusher on a second contact block stack-mounted to the first contact block. This mounting configuration limits the solid height. Accordingly, there is a need for a contact block assembly and a method of assembling a contact block assembly with a return spring positioned outside the pusher.

SUMMARY OF THE INVENTION

The present invention relates to a contact block assembly comprising a pusher having a body portion; a window formed in the body portion; a movable contact positioned within the window; a recess formed in the body portion; a first spring positioned within the recess and abutting the movable contact; and second spring positioned outside the pusher and abutting the movable contact.

According to another aspect of the invention, a method of assembling a contact block assembly, the method comprising the steps of inserting a first spring into a recess in a pusher; inserting a movable contact within a window of the pusher and in contact with the first spring; and positioning a second spring outside the pusher and in contact with the movable contact is disclosed.

It is an object of the invention to provide a contact block assembly having a reduced pusher return force.

It is a further object of the invention to provide a reduced pusher return force without increasing the height of the contact block assembly.

It is a further object of the invention to provide a greater electrical spacing between contact blocks which are mounted back to back.

Other objects and advantages will become apparent from the following specification taken in connection with the accompanying drawings.

DESCRIPTION OF THE PREFERRED EMBODIMENTS

Figure 1:
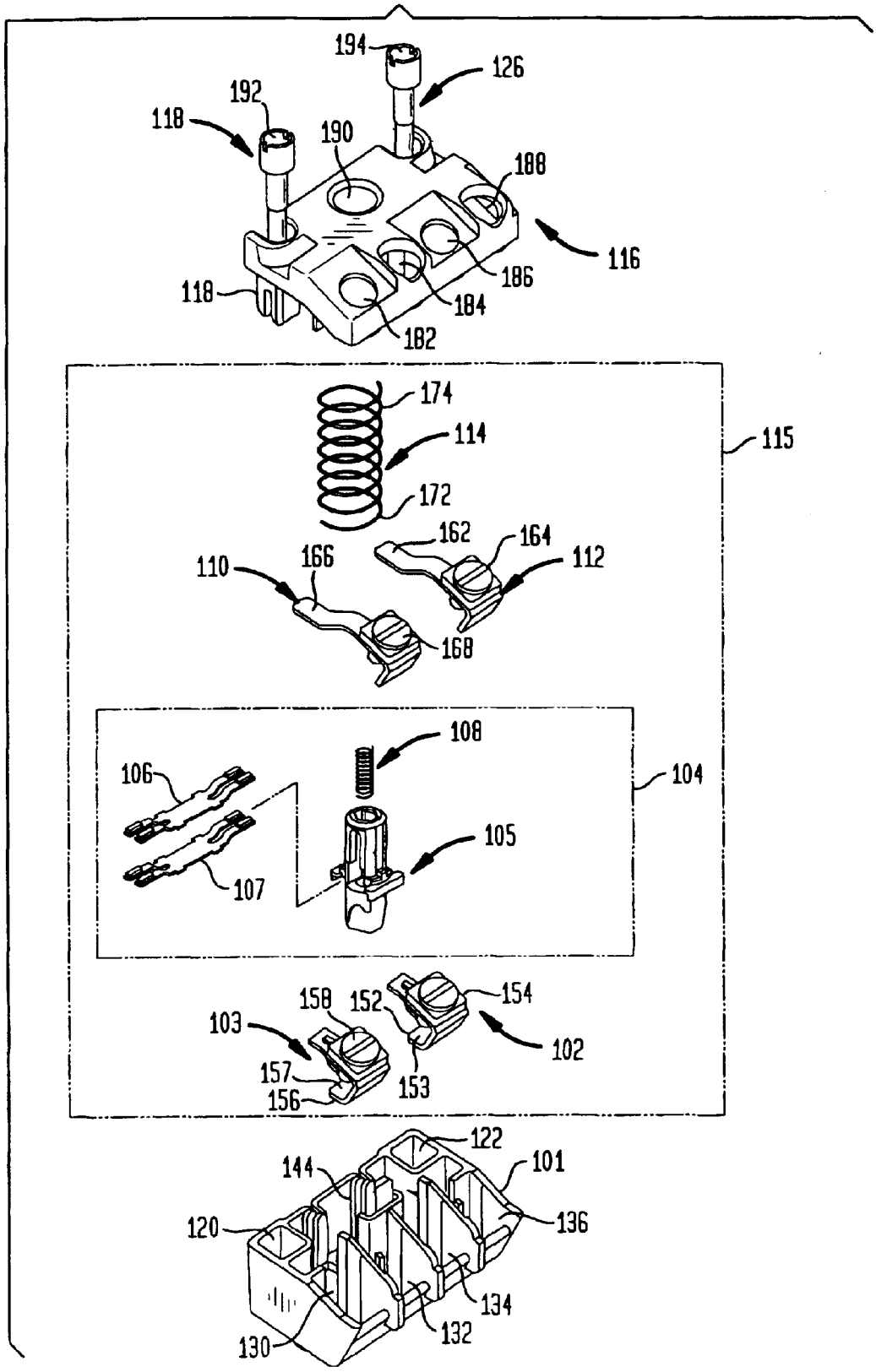
FIG. 1 is an exploded view of a contact block assembly according to the present invention.

Turning first to FIG. 1, an exploded view of a contact block assembly 100 according to the present invention is shown. The contact block assembly 100 comprises a lower housing 101 for receiving stationary contacts 102 and 103, and a pusher assembly 104. The pusher assembly 104 includes a pusher 105, a movable contact 106 and a contact spring 108. The contact block assembly 100 further includes stationary contacts 110 and 112. Although four stationery contacts are shown for a two pole contact block assembly, two stationery contacts could be employed in a one pole contact block assembly, as is well known in the art. Also, the orientation or shape of the stationery contacts could vary, depending upon whether the contact block assembly 100 is configured to be in an "normally open" or "normally closed" arrangement, as is well known in the art. The contact block assembly further includes a return spring 114 and a cover 116. When the contact block is assembled, a snap 118 is coupled to a complimentary receiving portion 120 to secure the cover 116 to the lower housing 101. A similar snap (not visible) is coupled to a second receiving portion 122. Finally, screws 124 and 126 enable contact blocks to be stacked or an operator to be attached to a contact block, as is well known in the art.

The lower housing 101 further includes recesses 130, 132, 134, and 136 for receiving the stationery contacts 102, 103, 110, and 112. The lower housing 101 further includes a recess 144 for receiving the pusher assembly 104. The stationery contact 102 further includes a contact portion 152 and a contact screw 154. A contact surface 153 is associated with the contact portion 152. Similarly, a contact portion 156, a contact surface 157 and a contact screw 158 are shown on the stationery contact 103. The stationery contact 112 includes a contact 162 and a contact screw 164, while the stationery contact 110 includes a contact 166 and a contact screw 168. Contact surfaces (not visible) are formed on the underside of contacts 162 and 166. The return spring 114 extends from a first end 172 to a second end 174. Finally, cover 116 includes recesses 182, 184, 186, and 188 for enabling access to contact screws 154, 158, 164, and 168. Also, a recess 190 and threaded portions 192 and 194 enable the coupling of multiple contact block assemblies, as is well known in the art.

Figure 2:
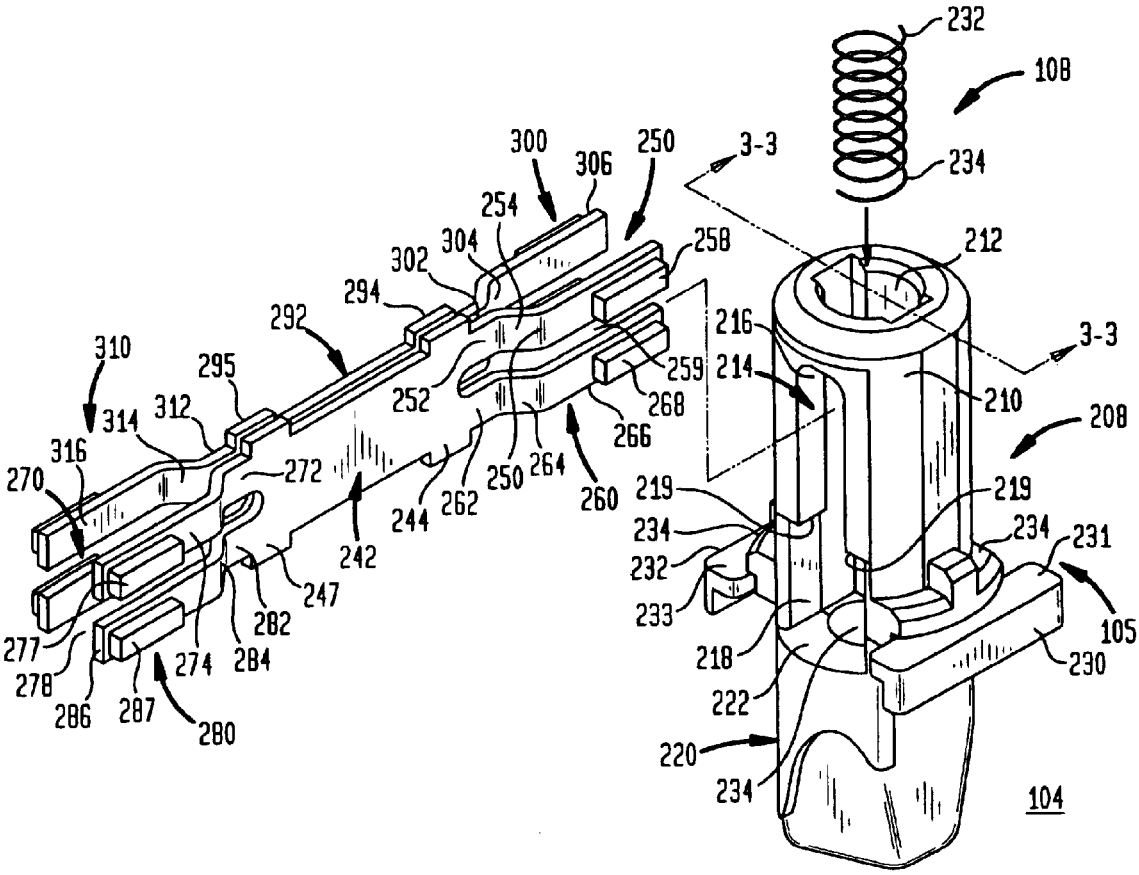
FIG. 2 is an exploded view of a pusher assembly according to the present invention.

Turning now to FIG. 2, an exploded view of the pusher assembly 104 is shown. The pusher 105 comprises a body portion 208 which includes an upper portion 210 having a recess 212 formed at a first end of the pusher 105, as shown at the top in the orientation of FIG. 2. The recess 212 enables an easy loading of the contact spring (i.e. the contact spring does not need to be compressed to be loaded into the pusher 105, but merely dropped into the recess 212). A window 214 is also formed in a side of the pusher 105, and extends through the back side (not visible). The window 214 includes an entry window portion 216 and a main window portion 218. The entry window portion 216 is long enough and wide enough to receive the movable contact 106 in the orientation shown in FIG. 2, as will be described in more detail in reference to the remaining figures. Similarly, the main window portion 218 is long enough and wide enough to allow the rotation of the movable contact 106 to a second orientation, such as the orientation shown in FIG. 5. The positioning of the entry window portion 216 and the main window portion 218 adjacent to each other creates shoulder portions 219 as shown in FIG. 2. The assembly of the pusher assembly 104 will be described in more detail in reference to FIGS. 4 and 5.

The pusher assembly 105 further includes a lower body portion 220 having a ledge 222 and a lower recess 224. The spring 108, which extends from a first end 226 to a second end 228, is generally inserted through the recess 212 into the lower recess 224. Finally, pusher 105 includes a first mounting arm 230 having a ledge 231 and a second mounting arm 232 having a ledge 233. The mounting arms 230 and 232 further include guides 234 and 235 respectively for receiving and properly positioning the return spring 114.

The mounting arms 230 and 232 may be of a different size and/or shape to prevent an inadvertent error in inserting the pusher assembly into a contact block housing. In particular, by forming the first mounting arm 230 and the second mounting arm 232 of different shapes, the incorrect insertion of the pusher assembly into a contact block assembly could be avoided.

The movable contact 106 comprises a body portion 242 which is substantially flat. The flat body portion of the movable contact further enables an easy assembly of the pusher. As will be described in detail in reference to FIGS. 5 and 6, the movable contact 106 is easily moved into the main window portion 218 because the contact spring 108 is retained in the lower recess 224. Any compression of the contact spring 108 into the recess will not cause the contact spring 108 to become dislodged from the lower recess 224. The body portion being substantially flat on both sides also enables mounting for both normally open and normally closed configurations.

The movable contact also has a first flange 244 extending from a first side and a second flange 245 extending from a second side. The movable contact 106 includes a second set of flanges including a third flange 246 extending from the first side and a fourth flange 247 extending from the second side. Flanges 244 through 247 are generally included to retain the movable contact 106 within the pusher 105. Although four flanges are shown, two flanges could be used to retain the movable contact 106 within the pusher 105. While the flanges as shown are symmetric, the number, shape and/or orientation of flanges could be chosen to prevent the improper insertion of the movable contact 106 into the pusher 105.

The movable contact 106 further includes a first contact element 248 extending from a first end of the body portion 242. The first contact element 248 includes a first finger 250 having a fulcrum portion 252, an inclined portion 254, and a contact portion 256. The contact portion includes a contact surface 258. The contact surface could be composed of any conductive material, such as silver, applied by plating, bonding, soldering or some other suitable method. A slot 259 separates the first contact finger 250 from a second contact finger 260. The second contact finger 260 comprises a fulcrum portion 262, an inclined portion 264, and a contact portion 266, also having a contact surface 268.

A second contact element 269 extending from a second end of the movable contact includes a third finger 270 having a fulcrum portion 272, an inclined portion 274, and a contact portion 276 having a contact surface 277. A slot 278 separates the third contact finger 270 from a fourth contact finger 280. Similarly, the fourth contact finger includes a fulcrum portion 282, an inclined portion 284, and a contact portion 286 having a contact surface 287.

Also shown in FIG. 2 is a body portion 292 and flanges 294 and 295 of the movable contact 107, which is adjacent to movable contact 106. A first finger 300 extends from a first end of the body portion 292 and has a fulcrum portion 302 leading to an inclined portion 308 and a contact portion 306. Similarly, a third finger 310 includes a fulcrum portion 312 and an inclined portion 314 leading to a contact portion 316. Although not visible in FIG. 2, a second and fourth finger are visible in FIG. 4, which shows a side elevation view of the movable contacts positioned in a back to back arrangement.

The movable contacts 106 and 107 have split or bifurcated contact fingers to increase the probability that they will make contact with the stationary contacts even in the presence of surface oxides and/or foreign particles on the contact surfaces. Maintaining independent motion of the bifurcated tips of movable contacts which are stacked back to back requires that the movable contacts be slightly separated by an offsets in the contact fingers. That is, the inclined portions of the fingers of the movable contacts enables proper operation of the movable contacts when stacked back to back. Alternatively, a spacer could be used to create a separation.

Figure 3:
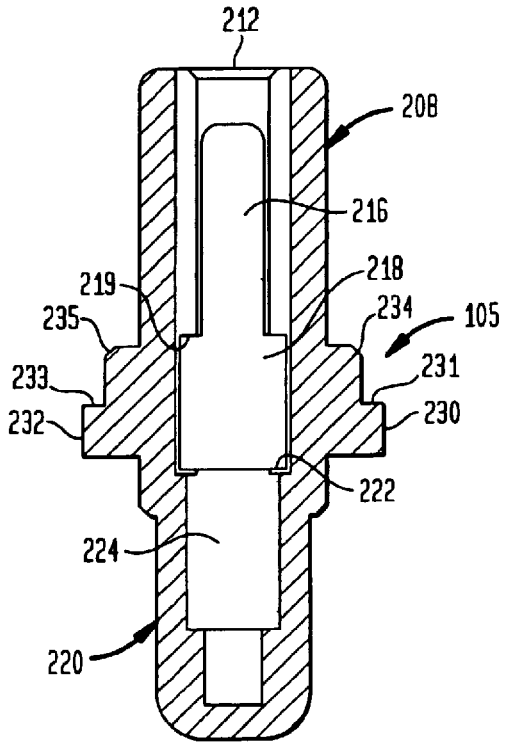
FIG. 3 is a cross-sectional view of the pusher of FIG. 2 taken at lines 3—3.

Turning now to FIG. 3, a cross-section of the pusher 105 is shown. As is more clear in this cross-section, the entry window portion 216 and the main window portion 218, as shown, extend through the upper body portion 210. Also shown is recess 212 extending through the top of the upper body portion 219 to recess 224 in the lower body portion 220 for receiving the contact spring 108.

Figure 4:
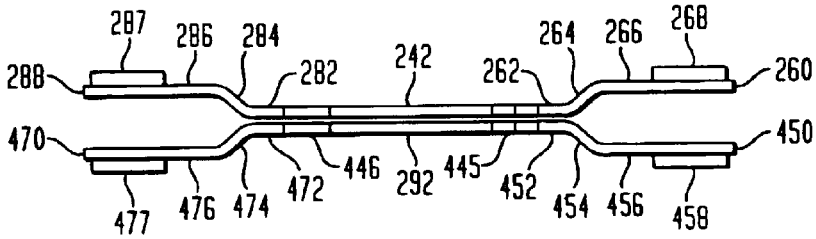
FIG. 4 is a side elevational view of a pair of movable contacts according to the present invention.

As shown in FIG. 4, the movable contacts 106 and 107, when positioned back to back, create a stacked movable contact pair which can be used in a two pole contact block assembly. Generally, the body portions 242 and 292 lay flat against each other. A second contact finger 450 extends from a first end of body portion 292 and includes a fulcrum portion 452 and an inclined portion 454 leading to a contact portion 456. A contact surface 458 is also preferably applied to the contact portion 456. Flanges 445 and 446 are also visible on a second edge of the body portion 292. Finally, a fourth finger 470 extends from a second end of the body portion 292. In particular, a fulcrum portion 472 and an inclined portion 474 lead to a contact portion 476. Preferably, a contact surface 477 is applied to contact portion 476.

Figure 5:
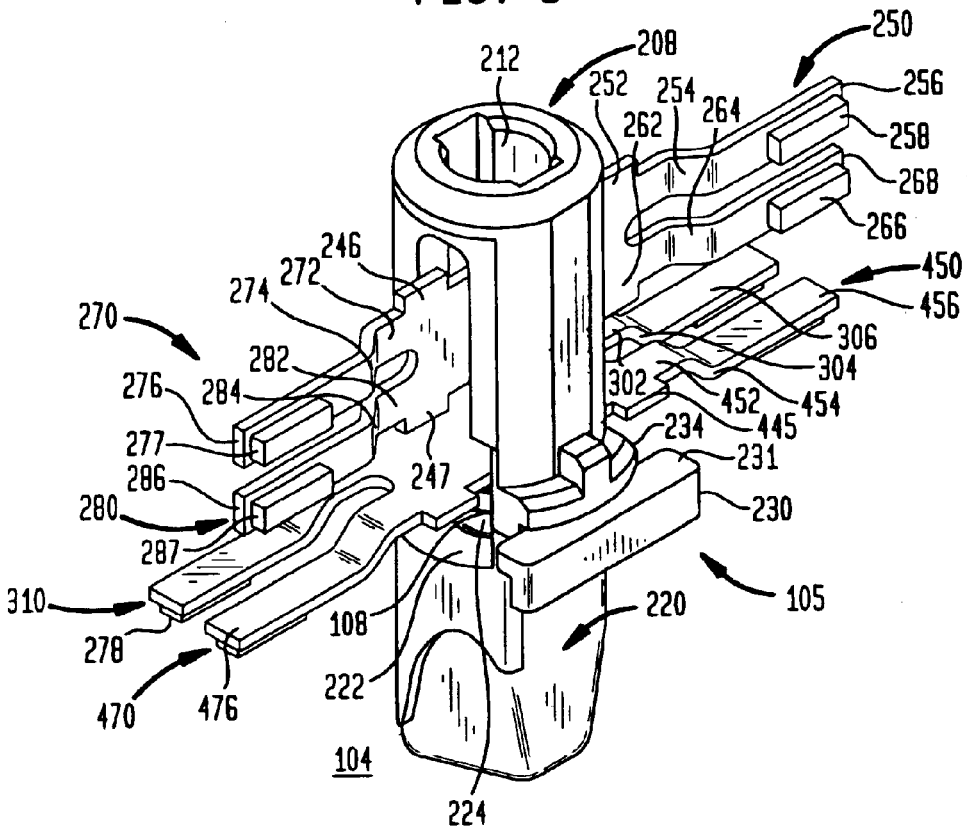
FIG. 5 is a perspective view of the pusher assembly during a first stage of assembly according to the present invention.
Figure 6:
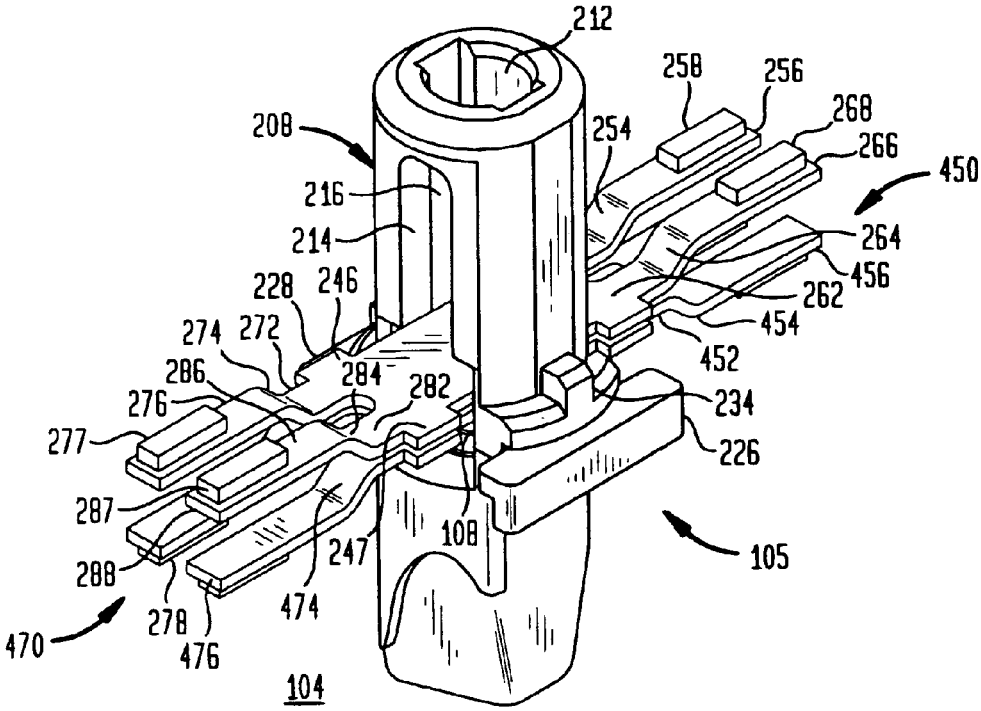
FIG. 6 is a perspective view of the pusher assembly at a second stage of assembly according to the present invention.

Turning now to FIGS. 5 and 6, the method of assembly of the pusher assembly 104 is shown. In particular, the movable contacts 106 and 107 are inserted into the upper window portion 216 in the vertical position. As shown in FIG. 5, the movable contact 107 is already positioned within the main window portion 218. That is, the movable contact 107 was moved downward from the entry window portion 216 into the main window portion 218 by depressing the contact spring 108. When the side of the movable contact 107 cleared the lower end of the entry window portion 216 at the shoulder portions 219, the movable contact 107 was then rotated into a horizontal position as shown in FIG. 6. The force of the contact spring 108 urges the movable contact 107 to a resting position against the shoulders 219. That is, the body portion 292 makes contact with the shoulders 219. The movable contact 106 is then inserted in the same manner. However, the movable contact 106 should be rotated such that the movable contacts are positioned in a back to back arrangement as shown in FIG. 6.

As also can be see in FIG. 6, the flanges 246 and 247 extend beyond the main window portion 218 preventing any lateral movement of the movable contact 106 within the main window portion 218. The flanges 244 and 245 also prevent any lateral movement of the movable contact 106 in the opposite direction. Similarly, flanges 294, 295, 445 and 446 of the movable contact 107 limit its movement within the pusher.

Although a method of assembling the pusher assembly by inserting the movable contacts 106 and 107 into the main window portion 218 separately, the movable contacts 106 and 107 could be inserted into the pusher 105 simultaneously. In particular, the movable contacts 106 and 107 could be positioned back to back as shown in FIG. 2, and then inserted into the entry window portion 216. If the entry window portion 216 is not wide enough to receive both movable contacts 106 and 107 simultaneously, the movable contacts 106 and 107 could be inserted into the entry window 216 separately, and then moved simultaneously into the main window portion 218. That is, with the movable contacts positioned back to back in the orientation shown in FIG. 2, the movable contacts are then moved simultaneously from the entry window portion 216 into the main window portion 218 by depressing the contact spring 108. The movable contacts 106 and 107 are then moved into a resting position as shown in FIG. 6 by simultaneously rotating the movable contacts 106 and 107 into a horizontal position.

The assembled pusher assembly 104 shown in FIG. 6 provides considerable advantage in the assembly of a contact block assembly shown in FIG. 1. In particular, once the pusher assembly 105 is assembled, an assembler of the contact block assembly 100 need not be concerned that the movable contacts 106 and 107 or the contact spring 108 will become dislodged during assembly. Similarly, the pusher assembly 104 could be assembled prior to any assembly of the contact block assembly 100, providing flexibility in assembling the contact block assembly 100. While the movable contact 106 is shown resting against the shoulders 219, the movable contact may not be resting against the shoulders when the contact block assembly 100 is assembled or operated.

Figure 7:
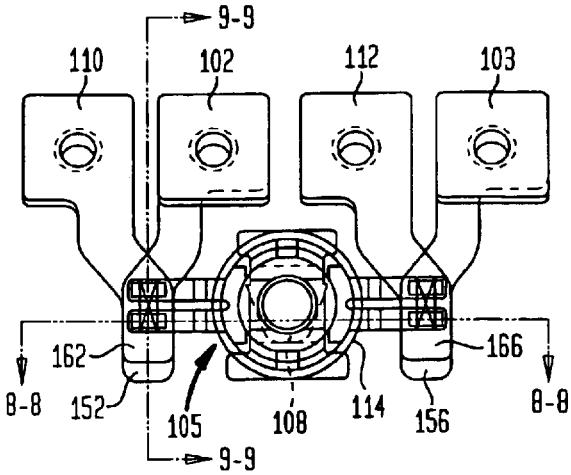
FIG. 7 is a top plan view of elements of a pusher assembly according to the present invention.
Figure 8:
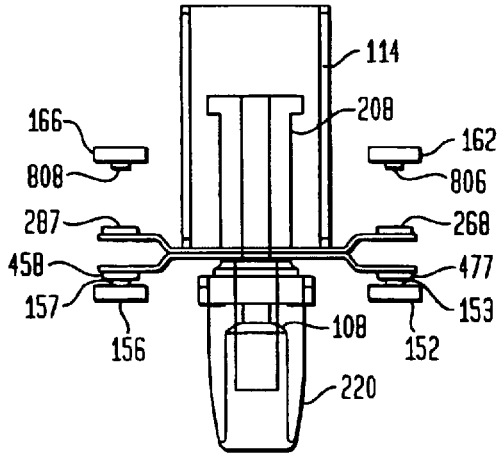
FIG. 8 is a cross sectional view of elements of a pusher assembly taken at lines 8—8 according to the present invention.

Turning now to FIGS. 7 and 8, a perspective view of the assembled components 115 shows the operation of a contact block assembly incorporating a pair of back to back movable contacts according to the present invention. When in a full-out position, contact surfaces 458 and 477 of the movable contact 107 make contact with corresponding contact surfaces 157 and 153 of stationary contacts 156 and 152, respectively. When the pusher is pressed by an external driving element such as a push button or selector switch, contact surfaces 287 and 268 of the movable contact 106 make contact with corresponding contact surfaces 808 and 806 of stationary contacts 166 and 162, respectively.

Figure 9:
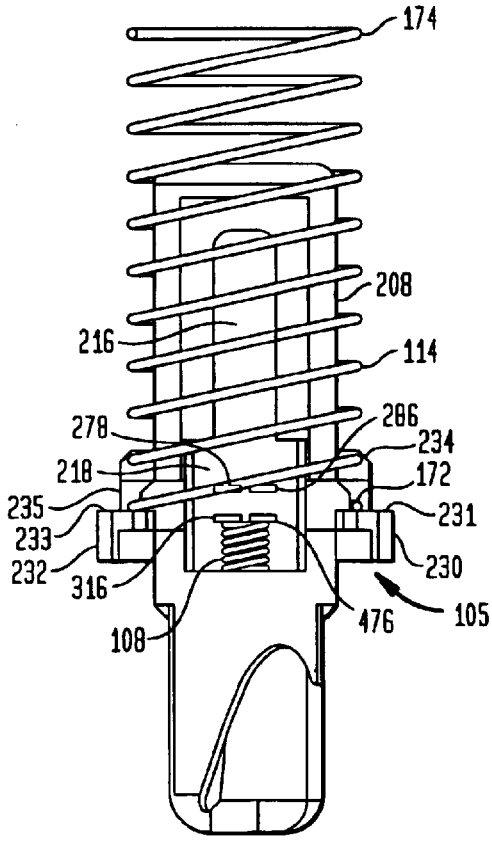
FIG. 9 is a perspective view of a pusher having a return spring surrounding the pusher according to the present invention.

Turning now to FIG. 9, a cross sectional view of FIG. 7 taken at lines 9—9 shows the interrelationship between the contact spring 108, the movable contacts 106 and 107, and the return spring 114. Depending upon the position of the pusher 105 with respect to the housing 101 and the cover 116 in an assembled contact block assembly, the contact spring 108 and the return spring 114 act on the movable contacts 106 and 107 to position them in the correct location and with the correct force upon a stationary contact. The following are exemplary specification of springs which could be used according to the present invention:

| Spring Specification | Contact Spring 108 | Return Spring 114 |
|---|---|---|
| Outer Diameter | .120 in. | .420 in. |
| Total Turns | 17½ turns | 14 turns |
| Max. Allowable Height (Compr.) | .225 in. | .401 in. |
| Initial Working Force (+/− 15%) | .061 lb. | .389 lb. |
| Initial Working Length | .421 in. | .707 in. |
| Final Working Force (+/− 15%) | .188 lb. | .637 lb. |
| Final Working Length | .309 in. | .457 in. |

When the contact assembly is assembled, both the contact spring 108 and the return spring 114 act upon the movable contact 106. That is, the return spring 114 provides a force on the movable contacts 106 and 107 to create a contact between movable contact 107 and stationary contacts 152 and 156. The contact spring 108 serves to hold the pusher off the movable contact. This provides over-travel so that a slight movement of the pusher will not interfere with the contact between the movable contact 107 and the stationary contacts 152 and 156.

As the pusher is gradually pushed in, the end 172 of return spring 114 makes contact with ledges 231 and 232 of the first mounting arm 230 and the second mounting arm 232, respectively. Accordingly, as the pusher 105 is advanced, the return spring 114 no longer provides any contact force for the movable contact 107 against the stationary contacts 152 and 156. However, as the pusher 105 is further advanced, the movable contact 106 makes contact with the stationary contacts 162 and 166 and the contact spring 108 provides the force to ensure a good contact between the movable contact 106 and the stationary contacts 162 and 166. Therefore, through the various stages of travel, the contact spring 108 and the return spring 114 provide the necessary forces for the movable contacts 106 and 107 to make contact with the appropriate stationary contacts. The unique configuration of the contact spring 108, the movable contacts 106 and 107, and the return spring 114 allows for the construction of a 2-pole (i.e. one normally open and one normally closed) contact block whose return force is the same as that of 1-pole contact blocks, because the return spring 114 serves as a contact spring for the normally closed contact. The contact block assembly 101 enables this function by incorporating the mounting arms 230 and 232 acting as stops for the return spring 114 on the outside of the pusher 105.

Figure 10:
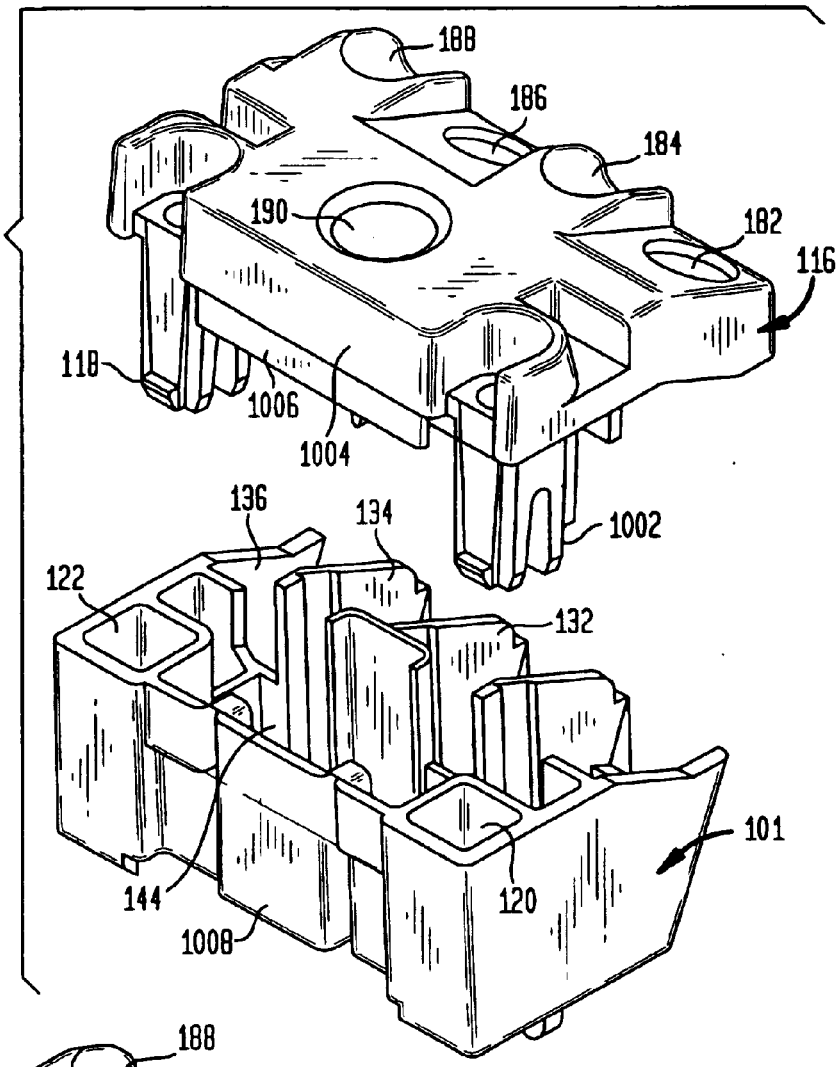
FIG. 10 is a perspective view of housing and cover of a contact block assembly according to the present invention.
Figure 11:
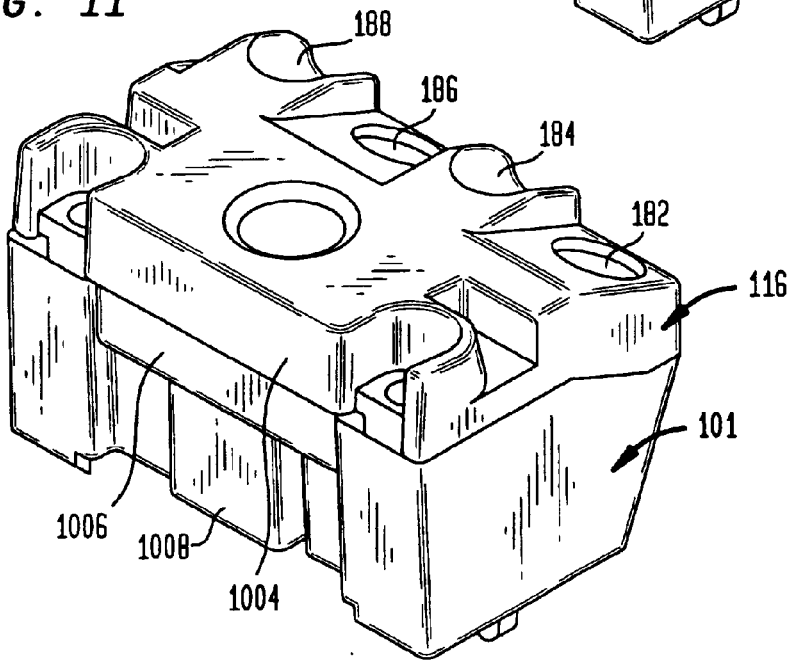
FIG. 11 is a perspective view of an assembled housing and cover according to the present invention.

Turning now to FIGS. 10 and 11, perspective views show the housing 101 and the cover 116 which are coupled to retain the pusher assembly 104, the return spring 114, and any stationary contacts which may be employed in the design of the contact block assembly 100. Because the pusher on a second contact block mounted to the first contact block is free to travel in a plastic tube that is completely within the inside diameter of the return spring, the return spring in the contact block of the present invention (which is mounted outside the pusher) can be mounted against the cover, thereby creating a greater working length of the spring. The unique design of the housing 101 and the cover 116 also provides a greater electrical distance between the larger return springs of back to back contact block assemblies, thereby enabling the return contact spring to be placed outside of the pusher as disclosed in the present invention. In particularly, a rear wall 1004 of the cover 116 has a lip portion 1006. When the cover 116 is assembled with the housing 101, the lip portion 1006 covers a rear portion 1008 of the housing 101. Such an overlapping of the cover 116 and the housing 101 creates a greater electrical distance between contact springs of back to back contact assemblies.

It can therefore be appreciated that a new and novel contact block assembly and method for assembling a contact block assembly has been described. It will be appreciated by those skilled in the art that, given the teaching herein, numerous alternatives and equivalent will be seen to exist which incorporate the disclosed invention. For example, although two separate movable contacts are used, a single movable contact having the features of the back to back movable contact could be employed according to the present invention. As a result, the invention is not to be limited by the foregoing exemplary embodiments, but only by the following claims.

I claim:

1. A contact block assembly comprising:

a pusher having a recess formed in a body portion for receiving a first spring and a window formed in said body portion for receiving a movable contact;

a housing for receiving said pusher;

at least one stationary contact positioned within said housing;

a second spring positioned outside said pusher assembly and in contact with said movable contact; and a cover retaining said pusher and said second spring within said housing.

2. The contact block assembly of claim 1 wherein said window comprises a first window and a second window formed in a first portion of said body portion.

3. The contact block assembly of claim 2 further comprising a second movable contact positioned adjacent to said first movable contact within said second window.

4. The contact block assembly of claim 3 further comprising arms having guides.

5. The contact block assembly of claim 4 wherein said first spring is positioned on a first side of said movable contact and said second spring is positioned as a second side of said movable contact.

6. The contact block assembly of claim 1 wherein said cover comprises a lip covering said housing when said cover is coupled to said housing.

7. A contact block assembly for use with an operator, said assembly comprising:

a pusher having a body portion;

a recess formed in said body portion;

a first window formed in said body portion;

a second window formed in said body portion adjacent to said first window, said second window being larger than said first window and forming shoulder portions between said first window and said second window;

a first spring positioned within said recess;

a movable contact positioned within said second window and abutting said first spring;

a housing retaining said pusher, said first spring and said movable contact;

a second spring positioned outside said pusher and abutting said movable contact; and a cover coupled to said housing.

8. A method for assembling a contact block assembly, said method comprising the steps of:

inserting a first spring into a recess in a pusher;

inserting a movable contact within a window of said pusher and in contact with said first spring; and positioning a second spring outside said pusher and in contact with said movable contact.

9. The method of claim 8 wherein said step of inserting a movable contact comprises positioning a first side of a movable contact on a first end of said first spring.

10. The method of claim 9 wherein said step of positioning said second spring comprises positioning said second spring on a second side of said movable contact.

11. The method of claim 8 further comprising a step of positioning at least one stationary contact within a housing.

12. The method of claim 8 further including a step of positioning said pusher and said second spring into a housing.

13. The method of claim 8 further comprising a step of securing said pusher and said second spring within said housing with a cover.

14. A method for assembling a contact block assembly, said method comprising the steps of:

providing a pusher having a window;

inserting a first spring into a recess within said pusher inserting a pair of movable contacts into said window of said pusher and in contact with said first spring;

retaining said pair of movable contacts within said window with said first spring;

positioning a second spring outside said pusher and in contact with at least one contact of said pair of movable contacts; and retaining said pusher and said second spring within a housing.

* * * * *